United States Patent [19]

Peter

[11] Patent Number: 4,563,989

[45] Date of Patent: Jan. 14, 1986

[54] REGULATION SYSTEM FOR AN INTERNAL COMBUSTION ENGINE

[75] Inventor: Cornelius Peter, Stuttgart, Fed. Rep. of Germany

[73] Assignee: Robert Bosch GmbH, Stuttgart, Fed. Rep. of Germany

[21] Appl. No.: 713,108

[22] Filed: Mar. 19, 1985

Related U.S. Application Data

[63] Continuation-in-part of Ser. No. 521,477, Aug. 8, 1983, abandoned.

[30] Foreign Application Priority Data

Oct. 15, 1982 [DE] Fed. Rep. of Germany ..... 3238189

[51] Int. Cl.[4] ..... F02D 11/10; F02D 1/04; F02P 5/04

[52] U.S. Cl. ..... 123/339

[58] Field of Search ..... 123/339, 340, 341, 58 J, 123/344, 352, 418, 420; 364/431

[56] References Cited

U.S. PATENT DOCUMENTS

| | | | |
|---|---|---|---|
| 4,344,397 | 8/1982 | Geiger et al. | 123/339 |
| 4,344,398 | 8/1982 | Ikeura | 123/339 |
| 4,344,399 | 8/1982 | Matsumura et al. | 123/339 |
| 4,365,601 | 12/1982 | Yamazoe et al. | 123/339 |
| 4,378,776 | 4/1983 | Yamazoe et al. | 123/339 |
| 4,380,979 | 4/1983 | Takase | 123/339 |
| 4,406,262 | 9/1983 | Ikeura | 123/339 |
| 4,422,497 | 12/1983 | Komoda et al. | 123/339 |
| 4,425,886 | 1/1984 | Kurowia et al. | 123/339 |

FOREIGN PATENT DOCUMENTS

| | | | |
|---|---|---|---|
| 53-38818 | 4/1978 | Japan | 123/339 |

*Primary Examiner*—Raymond A. Nelli
*Attorney, Agent, or Firm*—Edwin E. Greigg

[57] ABSTRACT

An idling regulation system for an internal combustion engine is proposed, in which preferably the air throughput in the intake tube is regulated in accordance with the deviation between the set-point and actual rpm values, the temperature, and the like. In this manner, the air leakage of the throttle valve, for instance, is additionally detected in an idling regulation system, via a bypass final control element.

11 Claims, 4 Drawing Figures

FIG. 1
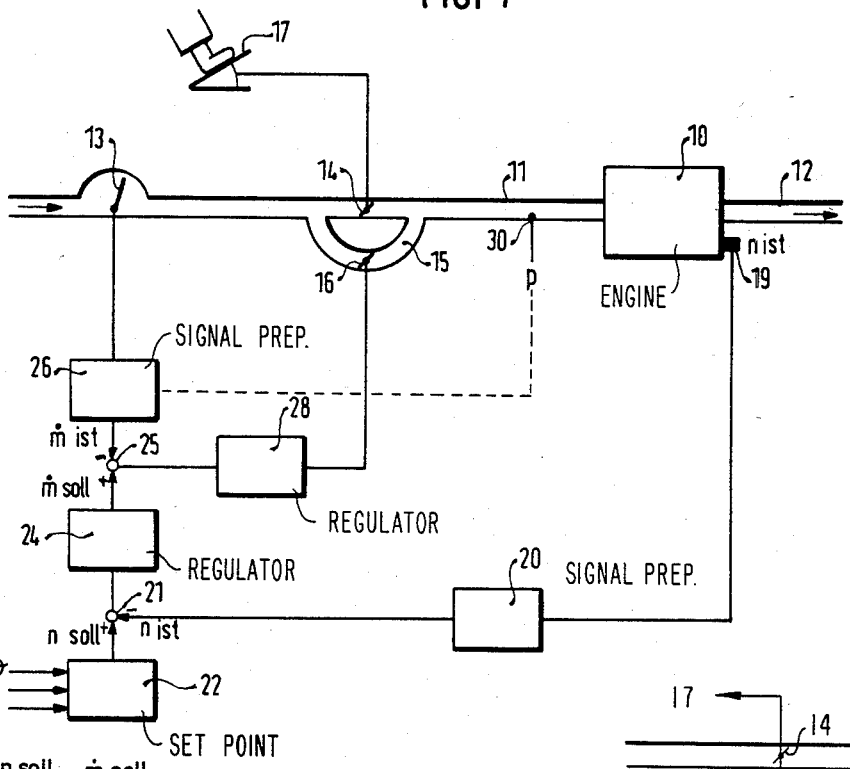
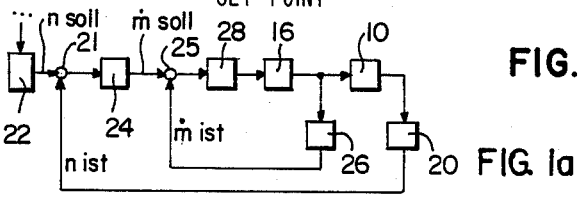
FIG. 1a
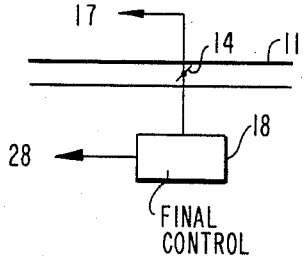
FIG. 1b
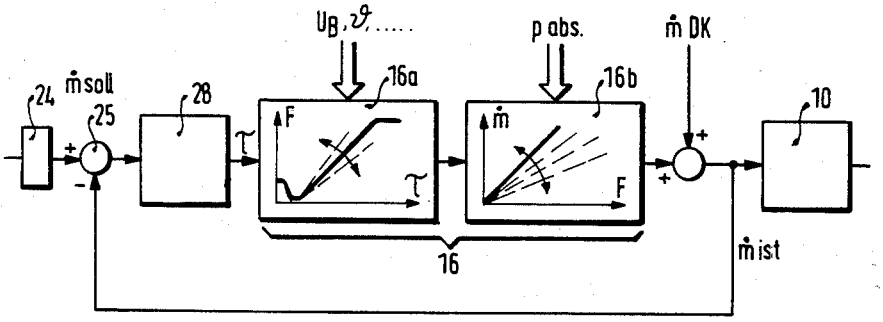
FIG. 2

REGULATION SYSTEM FOR AN INTERNAL COMBUSTION ENGINE

This is a continuation-in-part of application Ser. No. 521,477, filed Aug. 8, 1983, now abandoned.

BACKGROUND OF THE INVENTION

Idling rpm regulation in an internal combustion engine serves to keep the rpm as low as possible during idling for the sake of minimal fuel consumption, while nevertheless assuring that the engine will not stall in the event of any fluctuations in the load. A great number of idling regulating devices have already become known. German Offenlegungsschrift No. 27 49 369, for instance, describes an idling regulation system having a magnetic valve in the throttle bypass, the cross section of which is regulated in accordance with the deviation of the actual rpm value from the set-point rpm value. The set-point rpm value is based on operating characteristics, such as the engine temperature.

An improvement in the system known from German Offenlegungsschrift No. 27 49 369 is taught in German Pat. No. 26 32 613, according to which the position of the bypass cross section control device itself is supposed to be regulated.

It has now been demonstrated that even with known, improved idling regulation systems, optimal results are still not attainable. This is because even the position of the bypass cross section control device per se still does not furnish reliable information as to the operation of the final control element.

OBJECT AND SUMMARY OF THE INVENTION

The idling regulation system according to the invention assures that the events, that is, actual values of air-flow or air-throughput actually occurring in the intake tube of the engine can be detected and evaluated for use in idling regulation as well as in all other operating states of the engine. In particular, a governing of idling or any other operating state of the engine is affected by means of two superimposed closed control loops—an inner control loop for regulating air-throughput from the air intake tube to the engine to a predetermined reference or set-point value which is formed by an outer control loop that regulated the rpm of the engine to the desired value.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 1 is a rough block circuit diagram of an regulation system for an internal combustion engine;

FIG. 1*a* is a block schematic illustration showing the inner and outer closed loop control depicted in FIG. 1;

FIG. 1*b* illustrates a modification of the regulating system shown in FIG. 1; and FIG. 2 shows details of a regulating loop, in schematic form.

DESCRIPTION OF THE PREFERRED EMBODIMENT

FIG. 1, in schematic form, shows an internal combustion engine along with the various equipment and control unit components which are of importance to an understanding of the invention. Reference numeral 10 identifies an internal combustion engine, 11 an intake tube and 12 an exhaust gas line. An air quantity sensor 13 and a throttle valve 14 are disposed one following the other in the intake tube 11; a bypass conduit 15 having a bypass cross section control device 16 is associated with the throttle valve 14. This device 16 will henceforth be referred to merely as the bypass controller. The position of the throttle valve 14 is determined in accordance with the position of a driving pedal 17. Reference numeral 19 indicates an rpm sensor, which delivers its output signal via a signal preparation stage 20 to a comparison point 21. A block 22 indicates an rpm set-point control stage, in which a set-point rpm value is formed in accordance with various parameters such as the temperature, the operational mode of supplementary equipment such as the air conditioning, the automatic transmission (such as signals pertaining to DRIVE setting and so forth) and also the rpm.

The signal relating to the deviation between the set-point and the actual rpm values reaches a regulator 24, the output signal of which represents a set-point value for air throughput. A comparison point 25 follows for the actual air throughput signal from the air quantity sensor 13 entered via a signal preparation stage 26, and the set-point/actual-value deviation reaches the bypass controller 16 via an air throughput regulator 28.

In the apparatus shown in FIG. 1, it is advantageous that the regulator 24 indicates a set-point signal pertaining to the air throughput in the intake tube 11, that regulation is effected via the bypass controller 16, and that in forming the actual value for the air throughput not only are relationships pertaining to the bypass controller 16 taken into consideration in the process of regulation, but the air leakage in the throttle valve support is taken into consideration as well.

In FIG. 1*a* there is shown in greater schematic detail the two superimposed closed control loops for governing the regulation rpm of an internal combustion engine. An inner control loop regulates the air-flow or air-throughput from the air intake tube to the engine to a predetermined reference or set-point value. This set-point value is formed by the outer control loop, which thereby regulates the rpm of the engine to the desired value. The overall design of the idling rpm regulation according to the invention is such that the inner control loop, comprising elements 28, 16, 26, 25, regulates $\dot{m}_{ist}$ to $\dot{m}_{soll}$, where $\dot{m}$ is the air-throughput, and the outer control loop, comprising elements 24, inner control loop including the engine 10, and elements 20, 21 regulates $n_{ist}$ to $n_{soll}$, wherein n is rpm.

Block 26 forms the signal $\dot{m}_{ist}$, that is, the actual air-throughput, in accordance with an input signal. This input signal may be a measured air quantity, a measured air mass, the directly measured air-throughput from the intake tube to the engine, or the pressure in the air intake tube.

The signal $\dot{m}_{soll}$, that is, the set-point air-throughput from the intake tube to the engine, is generated by block 24 as previously mentioned. In other words the set-point value of the inner control loop is dependent on the outer control loop.

The set point signal of the output control loop, that is, the rpm set-point value $n_{soll}$, is formed by block 22, as previously mentioned. This embodiment 22 is a purely set-point value transducer, which forms its output signal in accordance with definite functions of predetermined input signals. Set-point value transducers of this kind are well known in the prior art, such as shown as element 28 in U.S. Pat. No. 4,441,471 and as element 33 described in U.S. Pat. No. 4,478,186, each having the same assignee, which patents are incorporated herein by reference.

The two regulators 28 and 24 of the inner and outer control loops, respectively, may be embodied arbitrarily according to such embodiments belonging to the prior art, for example a P, PI, or PID regulator. Such elements are shown as elements 18–21 in the above-mentioned U.S. Pat. No. 4,441,471 incorporated herein by reference.

The signal preparation stages 26 and 20 of the inner and outer control loops, respectively, are dependent on their respective input signals, and as such are well known in the prior art. The signal preparation stage 20, for example, can be found in element 15 shown in the aforementioned patent, U.S. Pat. No. 4,441,471, incorporated herein by reference, or it can be realized in the form of element 36 in U.S. Pat. No. 3,875,907, having the same assignee and incorporated herein by reference. The signal preparation stage 26 can be realized as element 11 in U.S. Pat. No. 4,275,694 having the same assignee and incorporated herein by reference, or as element 15 described in U.S. Pat. No. 4,437,339, also having the same assignee and also incorporated herein by reference.

These relationships are shown in detail in FIG. 2, which rather than showing all the individual components illustrates only those elements of importance in terms of regulation technology.

FIG. 2 shows the regulator 24, followed by a comparison point 25 for the comparing the set-point and actual values for the air throughput. That is followed in turn by a regulator 28, which has the P and/or D and/or I mode. The output signal of this special regulator is a clocked signal having a duty cycle $\tau$. In terms of signal technology the bypass controller can be divided into two blocks. Block 16*a* represents the relationship between the input signal $\tau$ and the opening cross section F of the bypass controller, or in other words the controller characteristic curve, which is a function of various influencing variables such as the operating voltage, temperature and so forth.

The next block, 16*b*, indicates the relationships between the bypass cross section F and the quantity of air $\dot{m}$ flowing therethrough. The influencing variables in this case are, for instance, the barometer level or absolute pressure, load, temperature and the like. In a subsequent summing point, the air leakage component $\dot{m}_{DK}$ of the throttle valve is added to this air flow through the bypass conduit to arrive at the total air throughput through the intake tube 11 of the engine 10. The measured total air throughput value $\dot{m}_{ist}$ is detected by means of the air throughput sensor 13 and delivered in the form of a signal to the comparison point 25.

The fact that so many variables influence the controller characteristic curve of block 16*a* and the relationships in block 16*b* makes it clear that in the present invention the static and dynamic behavior of the idling regulation loop functions independently of the controller characteristic curve, the altitude, the throttle valve air leakage and so forth, because in fact what takes place is not mere open-loop control but rather a closed-loop control, that is, regulation, of the entire air throughput in the intake tube.

For detecting the air throughput in the intake tube, flap-type air flow rate sensors and hot-wire air flow rate meters have proved to be particularly suitable. Depending upon the adaptation of the individual elements, however, it is also possible and advantageous to use a pressure signal in the intake tube 11 preceding the engine 10. This is indicated in FIG. 1 with a pressure sensor 30, which can feed its output signal into the signal preparation stage 26 as an alternative to the air throughput sensor 13, as shown by the dotted lines.

It has furthermore proved advantageous if the throttle valve 14, instead of having the bypass 15 of FIG. 1, is equipped with a throttle valve final control element 18, the position of rest of which is regulated in accordance with the present invention, as shown in FIG. 1*b*.

For one skilled in the art with knowledge of the present invention, the invention is realizable regardless of the manner of signal processing; that it, it is not critical whether the signal processing is analog or digital or is effected by means of a computer.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A regulation system for an internal combustion engine having an air intake tube comprising, means for generating actual values of air-flow in said intake tube, means for generating actual and reference values of rpm, means for comparing the actual and reference values of rpm, means for generating reference values of air-flow in said intake tube in response to said comparison means of the actual and reference values of rpm, means for comparing the actual and reference values of air-flow in said intake tube, means for controlling the air-flow in said air intake tube, and means for regulating said means for controlling air-flow in said air intake tube in response to said comparison means for the actual and reference values of air-flow in said intake tube, whereby said means for generating actual values of air-flow, said means for comparing actual and reference values of air-flow, said means for controlling air-flow, and said means for regulating said means for controlling air-flow comprise an inner control loop, and said internal combustion engine, said means for generating actual value of rpm, said means for comparing the actual and reference value of rpm, and said means for generating reference values of air-flow comprise an outer control loop.

2. A regulation system as defined by claim 1, wherein said means for generating actual values of air-flow comprises an air-mass meter in said air intake tube.

3. A regulation system as defined by claim 1, wherein said means for generating actual values of air-flow comprises an air quantity meter in said intake tube.

4. A regulation system as defined by claim 1, wherein said means for generating actual values of air-flow comprises an air-flow rate meter in said intake tube.

5. A regulation system as defined by claim 1, wherein said means for generating actual values of air-flow comprises an air-pressure meter in said air intake tube.

6. A regulation system as defined by claim 1, wherein said engine includes an air conditioning means and said regulating means includes means for generating reference values of the air-flow in accordance with a signal from said air conditioner.

7. A regulation system as defined by claim 1, wherein said engine includes an automatic transmission means, said regulating means includes means for generating reference values of the air-flow in accordance with a signal pertaining to the DRIVE setting in said automatic transmission means.

8. A regulation system as defined by claim 1, wherein said regulating means includes means for generating a reference value of the air-flow in accordance with an intake tube pressue value.

9. An idling regulation system as defined by claim 1, wherein said regulating means comprises a regulator device having at least one of the following: a proportioned, proportional integrating, proportional differentiating, and proportional integrating and differentiating mode of operation.

10. A method for regulating a system for an internal combustion engine having an air intake tube, comprising the steps of (1) generating actual values of air-flow in said intake tube, (2) generating actual and reference values of rpm, (3) comparing the actual and reference values of rpm, (4) generating reference values of air-flow in said intake tube in response to said comparison step of the actual and reference values of rpm, (5) comparing the actual and reference values of air-flow in said intake tube, (6) controlling the air-flow in said air intake tube, and (7) regulating said controlling step for the air-flow in said air intake tube in response to said comparison step for the actual and reference values of air-flow in said intake tube, whereby steps (1), (5), (6) and (7) comprise an inner control loop, and steps (2), (3) and (4) comprise an outer control loop.

11. A method according to claim 10, comprising the further step of generating a reference value of the air-flow in accordance with an intake tube pressure vlaue.

* * * * *